US010347436B2

(12) United States Patent
Johansson et al.

(10) Patent No.: US 10,347,436 B2
(45) Date of Patent: Jul. 9, 2019

(54) SWITCHING DEVICE

(71) Applicant: ABB Schweiz AG, Baden (CH)

(72) Inventors: Gunnar Johansson, Västerås (SE); David Karlén, Västerås (SE); Jonathan Jonsson, Västerås (SE); Markus Angell, Västerås (SE); Mats Henning Johansson, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/767,059

(22) PCT Filed: Oct. 8, 2015

(86) PCT No.: PCT/EP2015/073220

§ 371 (c)(1),
(2) Date: Apr. 9, 2018

(87) PCT Pub. No.: WO2017/059910

PCT Pub. Date: Apr. 13, 2017

(65) Prior Publication Data

US 2019/0066939 A1 Feb. 28, 2019

(51) Int. Cl.

| | |
|---|---|
| ***H01H 3/40*** | (2006.01) |
| ***H01H 9/38*** | (2006.01) |
| ***H01H 9/34*** | (2006.01) |
| ***H01H 1/20*** | (2006.01) |

(52) U.S. Cl.

CPC ..... *H01H 3/40* (2013.01); *H01H 9/346* (2013.01); *H01H 9/38* (2013.01); *H01H 9/383* (2013.01);

(Continued)

(58) Field of Classification Search

CPC H01H 3/40; H01H 9/22; H01H 9/346; H01H 9/38; H01H 9/383; H01H 71/1054; H01H 71/56; H01H 33/12; H01H 1/20

(Continued)

(56) References Cited

U.S. PATENT DOCUMENTS

| | | | | |
|---|---|---|---|---|
| 3,046,365 A | | 7/1962 | Graybill | |
| 4,039,983 A | * | 8/1977 | Terracol | H01H 9/38 335/16 |

(Continued)

FOREIGN PATENT DOCUMENTS

| | | |
|---|---|---|
| CN | 1317810 A | 10/2001 |
| CN | 203895376 U | 10/2014 |

(Continued)

OTHER PUBLICATIONS

International Search Report and Written Opinion Application No. PCT/EP2015/073220 Completion Date: Jan. 15, 2016; dated Jan. 25, 2016 11 pages.

*Primary Examiner* — Edwin A. Leon
*Assistant Examiner* — William A Bolton
(74) *Attorney, Agent, or Firm* — Whitmyer IP Group LLC

(57) ABSTRACT

A switching device for breaking an electric current including a main contact carrier, movable and stationary main contacts, the movable contact attached to the main contact carrier, an arcing contact carrier, a movable and stationary arcing contacts, the movable arcing contact attached to the arcing contact carrier and the stationary arcing contact arranged in parallel with the stationary main contact, and an actuating unit for the main and arcing contact carriers between open and close position at an actuating distance, wherein there are separation distances between the stationary and movable contacts of the main and arcing contact units respectively when the current is interrupted. The switching device further includes a first rack and a first gear for actuating the arcing contact carrier so that, when interrupting the current, a separation distance between the arcing contacts is longer than a separation distance between the main contacts.

18 Claims, 5 Drawing Sheets

(52) U.S. Cl.
CPC ..... *H01H 1/20* (2013.01); *H01H 1/2025* (2013.01); *H01H 1/2041* (2013.01); *H01H 9/34* (2013.01); *H01H 2201/024* (2013.01); *H01H 2201/026* (2013.01); *H01H 2225/004* (2013.01)

(58) Field of Classification Search
USPC ..... 218/14, 12, 16, 20, 21, 31, 37, 48; 200/501, 508; 335/16
See application file for complete search history.

(56) References Cited

U.S. PATENT DOCUMENTS

| | | | | |
|---|---|---|---|---|
| 4,421,959 | A * | 12/1983 | Chen | H01H 9/38 200/16 A |
| 4,871,889 | A * | 10/1989 | Leone | H01H 9/383 218/9 |
| 5,126,517 | A | 6/1992 | Torres-Isea et al. | |
| 5,210,385 | A * | 5/1993 | Morel | H01H 9/383 218/9 |
| 6,417,749 | B1 | 7/2002 | Kappel et al. | |
| 2014/0175060 | A1 | 6/2014 | Reymond et al. | |

FOREIGN PATENT DOCUMENTS

| | | | |
|---|---|---|---|
| DE | 1961398 | A1 | 12/1970 |
| DE | 2730726 | A1 | 1/1979 |
| EP | 2037472 | A2 | 3/2009 |
| FR | 2981789 | A1 | 4/2013 |
| JP | H07105817 | A | 4/1995 |

* cited by examiner

SWITCHING DEVICE

TECHNICAL FIELD

The present disclosure generally relates to a switching device for breaking a current. In particular it relates to a switching device including a stationary main contact and a stationary arcing contact arranged in parallel.

BACKGROUND

Switching devices are used for interrupting a current or protecting an electric circuit in the event of an electrical failure for example due to a short circuit. A Switching device may comprise contacts including a stationary and a movable contact, which during a normal operation are in mechanical and electrical connection. When the contacts are separated from each other a current breaking operation is effected. In addition to separating the contacts, a current breaking/interrupting operation involves extinguishing an arc between the contacts, and to force the current to decrease to zero.

When breaking a current without any natural zero-crossings, it is necessary to force the current down to zero. One common practice is to create a voltage across the breaking point that is higher than the system voltage thus forcing the current to decrease to zero. In order to achieve such a voltage across the breaking point it is desired to stretch the breaking arc over a long distance since the length of the arc increases the arc voltage and a long arc is also easily cooled and split into several shorter arcs that further increase the arc voltage.

An arc may be prolonged by either separating the contacts to a desired length so that the arc is stretched out or enabling the originally short arc to move along a path that stretches the short arc. When the contacts separate from each other at a limited distance, the arc must leave contact points quickly to avoid erosion of contact materials. Thus, an arc extinguishing chamber/chute is provided so that the arc moves away from the contacts into it, which further increases the arc voltage. It is desired that the arc moves along the desired path in a correct direction and with sufficient speed so that the arc voltage increases to a sufficient high value to break the current.

It is also known in the art that a so-called parallel make-and-break contact system may be used, wherein the system comprises a main contact assembly including a movable main contact and a stationary main contact and an arcing contact assembly including a movable arcing contact and a stationary arcing contact coupled in parallel with the main contact assembly. Different characteristics that are required for different modes of operations are thus optimized. In such a system, the main contacts normally only conduct the current and is not involved in the switching operations that create arcs. The material in the main contact is optimized for a good conductivity thus reducing the generated power when current is flowing. On the other hand, the arcing contacts are arranged to handle switching operations and are not meant for continuously conducting the current.

EP2037472A2 describes a switching system including main contacts and arcing contacts, wherein during a switching operation there is a timing between the main contacts and the arcing contacts so that all switching (opening or closing) are handled by the arcing contacts while the main contacts conducts an electric current when the circuit is closed and are not damaged by any switching operations.

SUMMARY

An object of the present disclosure is to provide a switching device for breaking a high current at a sufficient speed.

According to a first aspect of the present disclosure, a switching device is provided for breaking an electric current as defined in the preamble of claim 1. The switching device is further characterized in that a first rack and a first gear are provided for actuating the arcing contact carrier so that, when interrupting the current, a separation distance between the arcing contacts is longer than a separation distance between the main contacts.

Due to the arrangement of a rack and gear means, a longer separation distance and a higher separation speed between the arcing contacts are achieved. The longer distance between the arcing contacts enables a longer arc length, which consequently enables a creation of an arc voltage higher than a carrying voltage thus eventually forces the carrying current to decrease to zero, which consequently prolong the life of the switching device. Furthermore, the higher separation speed also enables the arc voltage to increase faster and consequently force the current to zero within a shorter time than with a low speed. A further advantage of the invention is that the actuating unit can be designed to act over the short distance required by the main contact while the long distance required by the arcing contact is created by the gear. An actuating unit for a short distance is easier to be built than an actuating unit for a long distance.

According to one embodiment, the arcing contact carrier is attached to either the first gear or the first rack. Furthermore, the gear ratio of the first gear is adapted such that a motion relation between the movable arcing contact and the movable main contact in a range of 2:1 to 8:1.

Each of the main and arcing contacts include a contact tip. Preferably, the material of the arcing contact tip is harder than the one of the main contact tip so that it better can withstand switching.

According to another embodiment, the switching device further includes a second rack and a second gear, wherein the first and second gears are co-mounted on a shaft and the radius of the first gear is bigger than the radius of the second gear. A proportion of the radius of the first gear and the radius of the second gear may be in a range of 2:1 to 8:1.

According to yet another embodiment, the second rack is attached to the main contact carrier.

Preferably, switching device may further include a third rack and a third gear. The first, second and third gears are co-mounted on a shaft with the first gear arranged in between the second and third gears, wherein the third gear has the same gear radius as the second gear. As the second gear, the third rack is attached to the main contact carrier. This structure provides a balance to the contacting system and avoids friction and other unsymmetrical drawbacks like wear.

According to a further embodiment of the invention, the switching device further comprises an arc extinguishing chamber including a plurality of U-, Y- or V-shaped arc splitters disposed with a distance to each other, the splitters are constructed and arranged so that a passage having a height is formed for the arcing contacts during a switching operation and the height of the passage is adapted such that, when a current is switched off/interrupted, during the most part of the separation distance, the movable arcing contact moves within the passage.

Furthermore, the passage formed by the arc splitters has a height and the height of the passage is adapted so that the separation distance of the arcing contacts is at least twice times than the one of the main contacts.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art.

A number of variations of a switching device for breaking a current will be described herein.

Figure 1:
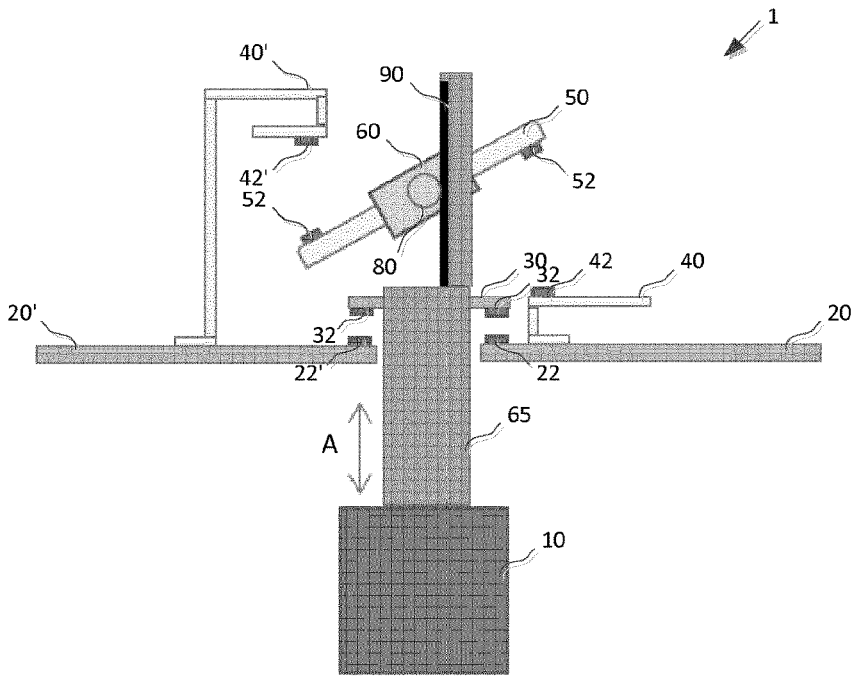
FIG. 1 shows a schematically sectional view of a switching device according to a first example of the invention.

FIG. 1 schematically shows a structure of a switching device 1 for breaking an electric current comprising a main contact assembly structure, an arcing contact assembly structure and an actuating unit 10.

The main contact assembly structure is responsible for carrying/conducting a current and includes a main contact carrier 65, a movable main contact 30 and a stationary main contact 20. The movable main contact 30 is attached to the main contact carrier 65 and a stationary main contact 20 is arranged to be engaged with the movable main contact 30.

The arcing contact assembly structure is responsible for experiencing arcs occurring during a switching operation that may be either a closing or an opening operation and includes an arcing contact carrier 60, a movable arcing contact 50 and a stationary arcing contact 40. The movable arcing contact 50 is attached to the arcing contact carrier 60 and the stationary arcing contact 40 is arranged to be cooperated with the movable arcing contact 50. Furthermore, the stationary arcing contact 40 is positioned in parallel with the stationary main contact 20.

The actuating unit 10 is vertically movable in a housing of the switching device 1 along a bi-direction denoted by an arrow A for actuating the main and arcing contact carriers 65, 60 from an open position to close position or vice versa, wherein there are separation distances between the stationary and movable contacts of the main and arcing contact units respectively when the current is interrupted, The switching device further includes a first rack 90 and a first gear 80, which may be directly or indirectly actuated by the actuating unit. A gear ratio of the first gear 80 is adapted such that a motion relation between the movable arcing contacts 50, 150 and the movable main contact 30,130 is in a range of 2:1 to 8:1. This means that the contact tips 52, 152 of the movable arcing contacts 50, 150 and the contact tips 32, 132 of the movable main contacts 30, 130 has a motion relation in a range of 2:1 to 8:1.

In this example, the first rack 90 is provided on the main contact carrier 65. The arcing contact carrier 60 is attached to the first gear 80. The teeth part of the first gear 80 meshes the teeth part of the first rack 90 so that the liner actuation is translated to a rotational movement of the arcing movable contact, which, during a breaking operation, enables the movable arcing contact move longer than the movable main contact thus create a bigger gap between the arcing contacts than the gap between the main contacts, and stretches out the arc and increases the arc voltage.

Figure 2:
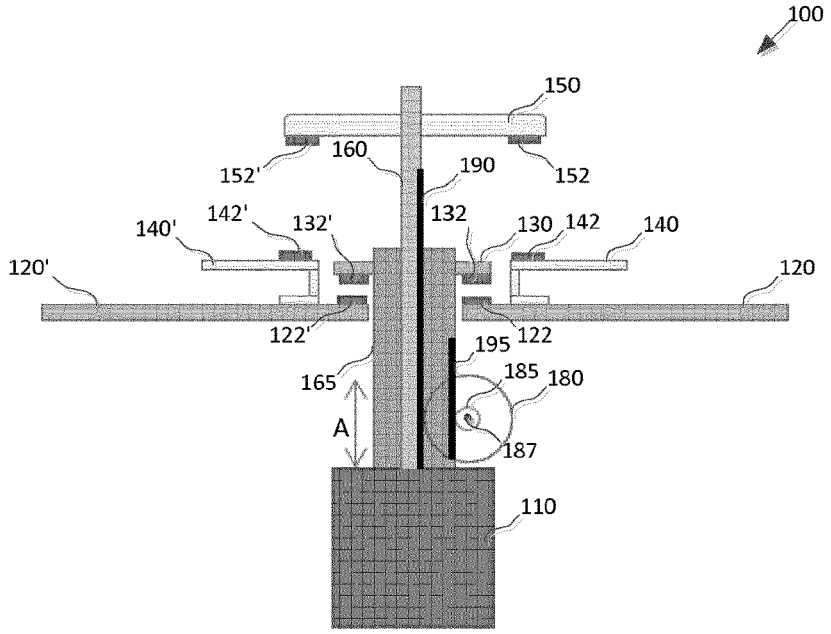
FIG. 2 shows a schematically sectional view of a switching device according to a second example of the invention.

FIG. 2 schematically shows a switching device 100 according a second example of the invention. The switching device 100 includes a first rack 190 and a first gear 180 arranged to be cooperated with the first gear. In this example, the switching device further includes a second rack 195 and a second gear 185 arranged to be cooperated with the second rack. The arcing contact carrier 160 is attached to the first rack 190. The second rack 195 is attached to the main contact carrier 165 that in turn is connected to the actuating unit 110. The first and second gears 180, 185 are co-mounted on a shaft 187.

During an interrupting/switching off operation, the actuating unit 110 actuates the main contact carrier 165 that in turn actuates the movable main contact 130 and the second rack 195. The main contacts 130 and 120 will be separated at a point of time. The second rack 195 and second gear 185 translate the liner movement of the actuation to a rotational movement of the gear 185. Since the first gear 180 and second gear 185 are mounted on the same shaft, the rotation of the second gear 185 is transferred to a rotation of the first gear 180. With the meshed first rack 190, the rotation of the first gear 180 is translated to a liner movement of the first rack 190 thus actuates the arcing contact carrier 160. The arcing contacts 140, 150 will be separated later than the main contacts 120, 130. Due to the fact that the radius of the first gear 180 is bigger than the radius of the second gear 185, the arcing contact carrier 160 moves longer and with a higher separation speed than the main contact carrier 165, which results in a bigger gap between the arcing contacts 140, 150 than the main contacts 120, 130. A proportion of the radiuses of the first gear and the second gear is in a range of 2:1 to 8:1, which presents a gear ratio in relation to an actuating distance. Thus, with a gear ratio for the movable arcing contact in relation to the actuating unit 4:1, if, during at least part of the movement of the actuating unit, the actuation unit 10, 110 and the movable main contacts 30, 130 move 10 mm, the movable arcing contacts 50, 150 may move 40 mm thus allowing the arc to be stretched out longer. A gear ratio will also affect the forces and a specific force at the arcing contact will be reflected to the actuation device with a magnitude that is multiplied with the gear ratio, i.e. 10N contact force will give 40N on the actuation device with this gear ratio.

It may be observed in FIGS. 1 and 2 that in either case the actuation unit 10, 110 acts directly on the main contact carrier so that the motion of the movable main contacts 30, 130 follows the motion of the actuation unit 10, 110. The main contacts 20, 30; 120, 130 need a high contact force in order to get a low contact resistance and this is achieved by the direct actuation. The arcing contacts 40, 50; 140, 150 may be directly or indirectly actuated by the same actuation unit 10, 110 but has a gear ratio in relation to it.

Both FIGS. 1 and 2 show parallel double break and make switching structures, wherein the two stationary arcing contacts 40, 40'; 140, 140' are positioned in parallel with the two stationary main contacts 20, 20'; 120, 120'. Each of the stationary arcing and main contacts 40, 40'; 140, 140'; 20, 20'; 120, 120' are aligned with the corresponding movable arcing and main contacts 50, 30; 150, 130. Each of the movable main and arcing contacts 50, 30; 150, 130 includes two arms, wherein a contact tip 52, 52'; 32, 32'; 152, 152', 132, 132' is displaced at each end of the arms facing the contact tips 42, 42'; 22, 22'; 142, 142'; 122, 122' of the corresponding stationary main and arcing contacts 40, 20, 140, 120, thus enable double contacting points connected in series for each of the arcing and main contacts when a contact is made. A contact tip may be also called as contact pad or contact surface on which a contact is made. It is advantageous to use a double break and make switching structure because this structure enables to reduce the separation length of the contacts to half of the length of a single break and make structure when generating a sufficient arc voltage. The structure thus enables a more compact switching device.

Preferably, the material of the arcing contact tip is harder than the one of the main contact tip so that it better can withstand switching. The material for the arcing contact tips is optimized for switching with low erosion and low tendency to weld/stick. For example, the material of the main contact tips may have a high silver content above 80%; while the material of the arcing contact tips may have a high content of tungsten above 50%.

Figure 3A:
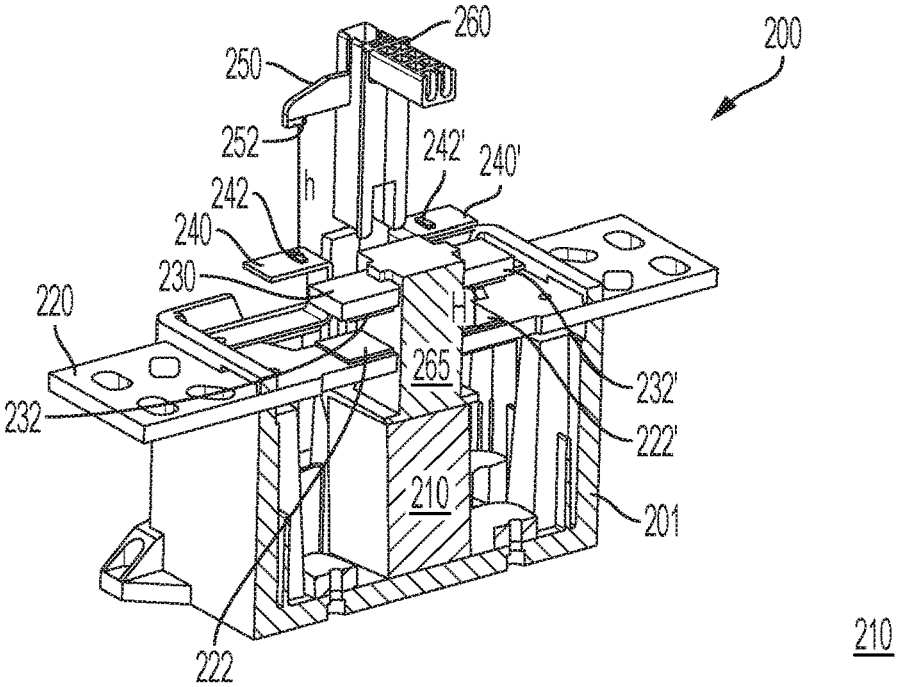
FIGS. 3*a*-3*f* show various views including isometric, cross-section and top views of a switching device according to a third example of the invention.
Figure 3B:
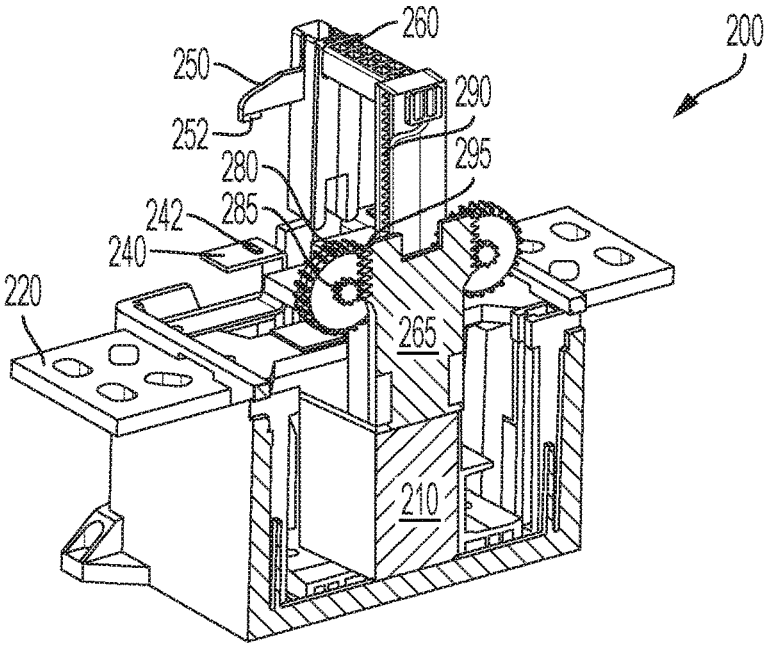
Figure 3C:
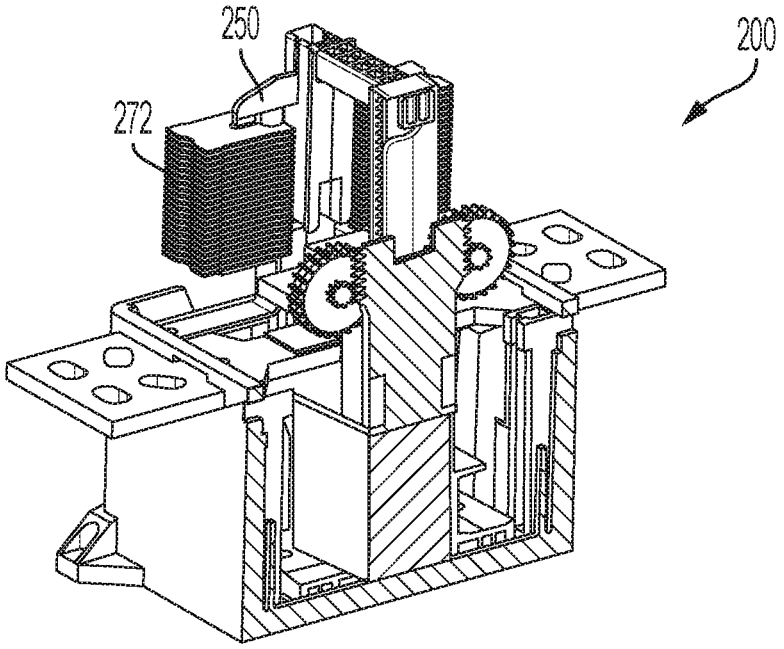
Figure 3D:
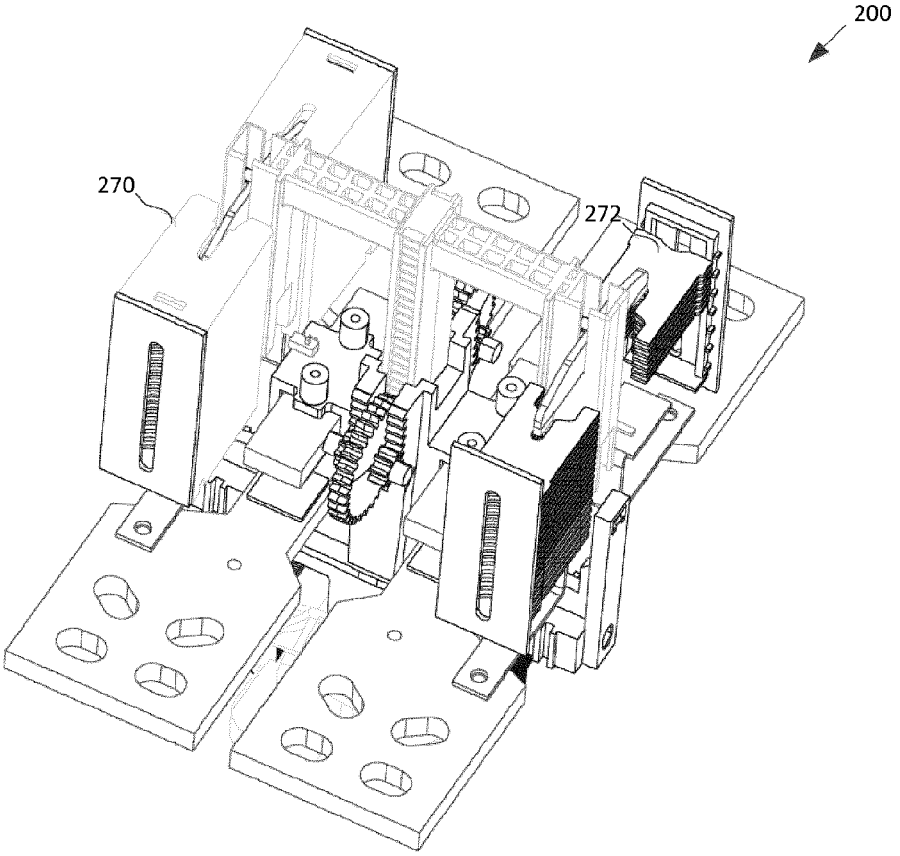
Figure 3E:
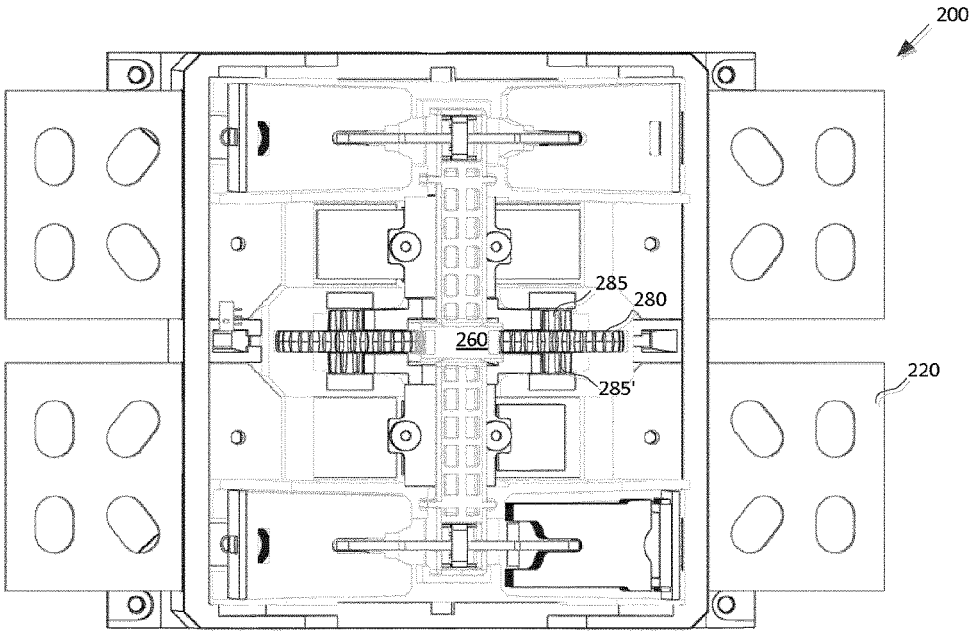
Figure 3F:
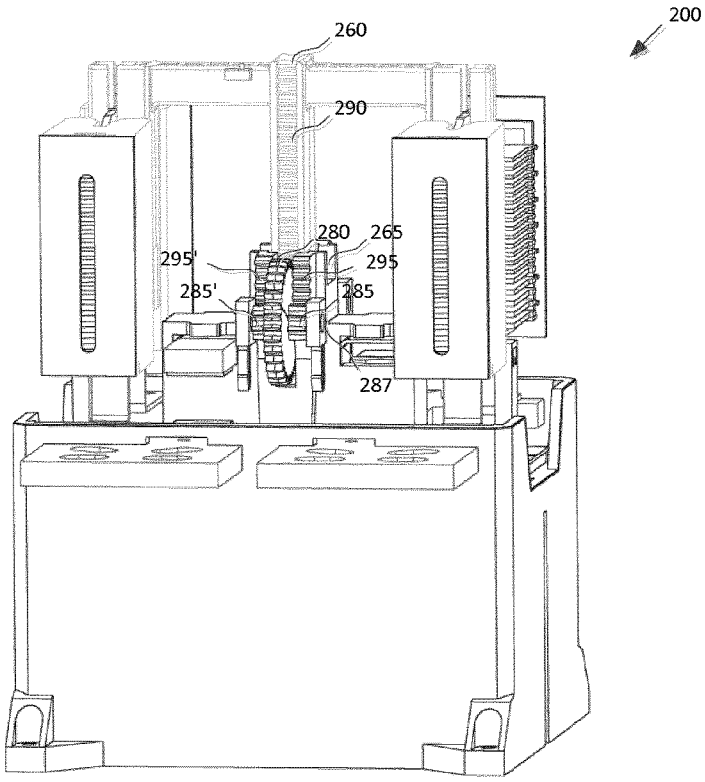

FIGS. 3*a*-3*f* show various views of a switching device according to a third example of the invention. For example, FIGS. 3*a*-3*c* are cross-section views; FIGS. 3*d* and 3*f* are isometric views; while FIG. 3*e* is a top view.

In this example, the switching device 200 is a two-pole DC contactor having a base 201. For each of the poles, there are provided with a movable arcing contact 250, and two stationary arcing contact 240, 240', and a movable main contact 230 and two stationary main contact 220, 220'. Furthermore, each of the stationary arcing contacts 240, 240' is attached to a corresponding stationary main contact 220 and is formed as a U-shaped bar. The movable arcing contact 250 is formed as a thin bar with two ends. A contact tip 252 is placed at the each of the ends. The movable main contact 230 is formed as a wider bar with two ends as well. A contact tip 232 is placed at the each of the ends. As illustrated in the FIGS. 3*a*-*b*, the contact tips 252, 242 of the arcing contacts 250, 240 have much smaller dimensions/surfaces than the contact tips 232, 222 of the main contacts 230, 220. The main contact surface may be larger than the arcing contact. Thus, for each of the pole, there is a parallel double break and make switching structure.

In this example, the switching device 200 further comprises an arc extinguishing chamber 270 enclosing the stationary arcing contacts 240 and movable arcing contacts 250 and including a plurality of U-shaped arc splitters 272 disposed in parallel to each other. The stationary arcing contacts 240, 240' are fixedly arranged just below the arc splitters while the movable arc contacts is above the arc splitters when the arcing contacts are finally separated. During a switching operation, the U-shape splitters 272 forms a narrow passage for the movable arcing contact 250 so that it moves alongside/adjacently to the edges of the U-shaped parts of the arc splitters 272. Each of the U-shaped splitters 272 extended with two arms 273, 273' that further enclose the passage. The construction makes the switching device more compact. Furthermore, the height of the extinguishing chamber 270 is adapted so that the height of the passage enables the movable arcing contacts move, during the most of the separation distance, inside the passage and at least twice times than the movable main contacts, meaning that at an opening position, the distance h between the arcing contacts is at least twice than the distance H of the main contacts. Consequently, the arc is well cooled in the passage by the arc splitters as it is stretched out and it is easier that the arc is split into several small arcs, then the small arcs enter between the arc splitters to be finally distinguished. Furthermore, the passage formed by the arc splitters has a dimension include a width and the width of the passage is less than twice times than the width of the movable arcing contact so that the movable arcing contacts is moving adjacently to the edge of the U-shaped splitters during a switching operation. This enables the size of the arc extinguishing chamber even impact. It should be understood that the arc splitters 272 may have other shapes like Y- or V-shaped and may displaced at a distance not necessarily in parallel to each other. For example, they may be displaced as a fan-shape.

Furthermore, in this example, for both poles, a single arcing contact carrier 260 and a single main contact carrier 265 are provided for carrying the movable arcing contacts 250, 250' and the movable main contacts 230, 230' respectively. The main contact carrier 256 is further connected/attached to a magnet 210 (details not shown) acting as an actuating unit.

With reference to FIGS. 3*e* and 3*f*, two sets of rack and gear assemblies are provided in this example.

In each of the sets, a second and a third gears 285, 285' with a smaller radius are provided on a shaft 287; while a first gear 280 with a bigger radius is mounted between the smaller gears 285, 285' on the same shaft 287. A second and third racks 295, 295' are arranged on the main contact carrier 265 to be engaged with the second and third gears 285, 285' respectively; while rack 290 is provided on the arcing contact carrier 260 and to be meshed with gear 280. This arrangement provides a balance for the contacting system and avoids friction and other unsymmetrical drawbacks, for example, mechanical wear causing inaccurate precision of contact tip positions and/or not simultaneously closing/opening of the double break contacts etc.

For all of the examples, dual contact actions occur during a switching operation, i.e. either a closing or an opening operation. When the switch is separated/open, the main contacts open first then followed by opening of the arcing contacts. When the switch is closed, the arcing contacts close first followed by closure of the main contacts. This means that during the switching operation arcing contacts experience/confront arcs occurred while the main contacts can avoid arcs caused by the switching operation.

It should be understood that a switching device based on the present invention may be used for interrupting either a DC or AC current and may be any of contactor, circuit breaker, or switch-disconnector.

It should be also understood that the invention not only improve a capability of braking/interrupting a high current but also a capability of breaking a low current. Usually for a high current switching device, it is designed to break a high current. However, when it is used to break a low current it may result in severe damages of the device. This is because that, for a low current it is difficult to move a low current arc away from contact tips and stretch it out by itself due to low magnetic force, thus the arc will likely stay at the contact tips and not enter an arc extinguishing chamber. The present invention enables an arc to be stretched out at a long distance within a narrow passage inside the arc extinguishing chamber so that even when the current to be broken is low, the low current arc can be still effectively cooled down meanwhile an arc voltage is increased at a sufficient speed and consequently the current is forced to zero. Thus, the invention is suitable for breaking a current up to 5000 A.

The invention claimed is:

1. A switching device for breaking an electric current comprising:

a main contact carrier, a movable main contact and a stationary main contact, wherein the movable main contact is attached to the main contact carrier, an arcing contact carrier, a movable arcing contact and a stationary arcing contact, wherein the movable arcing contact is attached to the arcing contact carrier and the stationary arcing contact is arranged in parallel with the stationary main contact, and an actuating unit for actuating the main contact carrier and the arcing contact carrier from an open position to close position or vice versa at an actuating distance, wherein there are separation distances between the stationary and movable contacts respectively when a current is interrupted, wherein the switching device further includes a first rack and a first gear for actuating the arcing contact carrier so that, when interrupting the current, a separation distance between the arcing contacts is longer than a separation distance between the main contacts.

2. The switching device according to claim 1, wherein the arcing contact carrier is attached to either the first gear or first rack.

3. The switching device according to claim 1, wherein a gear ratio of the first gear is adapted such that a motion relation between the movable arcing contact and the movable main contact is in a range of 2:1 to 8:1.

4. The switching device according to claim 1, wherein each of the main and arcing contacts include a contact tip, a material of the arcing contact tip is harder than a material of the main contact tip.

5. The switching device according to claim 1, further comprising a second rack and a second gear, wherein the first and second gears are co-mounted on a shaft and a radius of the first gear is bigger than a radius of the second gear.

6. The switching device according to claim 5, wherein the second rack is attached to the main contact carrier.

7. The switching device according to claim 5, wherein a proportion of the radius of the first gear and the radius of the second gear is in a range of 2:1 to 8:1.

8. The switching device according to claim 5, further comprising a third rack and a third gear, wherein the first, second and third gears are co-mounted on the shaft with the first gear in between the second and third gears, wherein the third gear has a gear radius that is equal to the radius of the second gear.

9. The switching device according to claim 8, wherein the third rack is attached to the main contact carrier.

10. The switching device according to claim 5, further comprising a second stationary main contact and a second stationary arcing contact positioned in parallel with the second stationary main contact 20', 120', 220', wherein each of the stationary arcing and main contacts are aligned with the respective movable arcing and main contacts and each of the movable main and arcing contacts includes two arms, each of the arms including two contact tips to be in contact with respective contact tips of the stationary main and arcing contacts.

11. The switching device according to claim 1, further comprising an arc extinguishing chamber including a plurality of U-, Y-, or V-shaped arc splitters disposed with a distance to each other, the splitters are constructed so that a passage having a height is formed for the arcing contacts during a switching operation and the height of the passage is adapted such that, when the current is switched off/interrupted, the movable arcing contact moves within the passage for most of the separation distance.

12. The switching device according to claim 11, wherein the height of the passage formed by the arc splitters is adapted so that the separation distance of the arcing contacts is at least twice the separation distance between the main contacts.

13. The switching device according to claim 2, further comprising a second rack and a second gear, wherein the first and second gears are co-mounted on a shaft and a radius of the first gear is bigger than a radius of the second gear.

14. The switching device according to claim 3, further comprising a second rack and a second gear, wherein the first and second gears are co-mounted on a shaft and a radius of the first gear is bigger than a radius of the second gear.

15. The switching device according to claim 4, further comprising second rack and a second gear, wherein the first and second gears are co-mounted on a shaft and a radius of the first gear is bigger than a radius of the second gear.

16. The switching device according to claim 2, further comprising an arc extinguishing-chamber including a plurality of U-, Y-, or V-shaped arc splitters disposed with a distance to each other, the splitters are constructed so that a passage having a height is formed for the arcing contacts during a switching operation and the height of the passage is adapted such that, when the current is switched off/interrupted, the movable arcing contact moves within the passage for most of the separation distance.

17. The switching device according to claim 3, further comprising an arc extinguishing-chamber including a plurality of U-, Y-, or V-shaped arc splitters disposed with a distance to each other, the splitters are constructed so that a passage having a height is formed for the arcing contacts during a switching operation and the height of the passage is adapted such that, when the current is switched off/interrupted, the movable arcing contact moves within the passage for most of the separation distance.

18. The switching device according to claim 4, further comprising an arc extinguishing-chamber including a plurality of U-, Y-, or V-shaped arc splitters disposed with a distance to each other, the splitters are constructed so that a passage having a height is formed for the arcing contacts during a switching operation and the height of the passage is adapted such that, when the current is switched off/interrupted, the movable arcing contact moves within the passage for most of the separation distance.

* * * * *